US011260679B2

(12) United States Patent
Pun

(10) Patent No.: US 11,260,679 B2
(45) Date of Patent: Mar. 1, 2022

(54) GRIPPING FOR PRINT SUBSTRATES

(71) Applicant: Kateeva, Inc., Newark, CA (US)

(72) Inventor: Digby Pun, San Jose, CA (US)

(73) Assignee: Kateeva, Inc., Newark, CA (US)

( * ) Notice: Subject to any disclaimer, the term of this patent is extended or adjusted under 35 U.S.C. 154(b) by 0 days.

(21) Appl. No.: 16/712,172

(22) Filed: Dec. 12, 2019

(65) Prior Publication Data

US 2020/0198374 A1 Jun. 25, 2020

Related U.S. Application Data

(60) Provisional application No. 62/783,729, filed on Dec. 21, 2018.

(51) Int. Cl.

| | |
|---|---|
| ***B41J 11/00*** | (2006.01) |
| ***B41J 13/00*** | (2006.01) |
| ***B41J 13/30*** | (2006.01) |
| ***B41J 13/28*** | (2006.01) |
| ***B41J 11/06*** | (2006.01) |
| ***B41J 11/22*** | (2006.01) |

(52) U.S. Cl.

CPC ..... *B41J 11/0085* (2013.01); *B41J 11/0055* (2013.01); *B41J 11/06* (2013.01); *B41J 11/22* (2013.01); *B41J 13/0027* (2013.01); *B41J 13/30* (2013.01); *B65H 2406/34* (2013.01)

(58) Field of Classification Search

CPC ..... B41J 11/0055; B41J 11/06; B41J 11/22; B41J 13/009; B41J 13/30

See application file for complete search history.

(56) References Cited

U.S. PATENT DOCUMENTS

| | | | | |
|---|---|---|---|---|
| 4,667,555 | A * | 5/1987 | Lisec | C03B 33/027 83/319 |
| 9,961,782 | B2 | 5/2018 | Pun et al. | |
| 2006/0054774 | A1 | 3/2006 | Yassour et al. | |
| 2007/0045499 | A1 | 3/2007 | Kim et al. | |
| 2009/0092472 | A1 | 4/2009 | Luo et al. | |
| 2012/0193878 | A1 | 8/2012 | Suzuki et al. | |
| 2014/0062112 | A1 | 3/2014 | Cho et al. | |
| 2015/0008688 | A1 | 1/2015 | Furuichi et al. | |

OTHER PUBLICATIONS

International Search Report and Written Opinion dated Feb. 14, 2020 in International Patent Application No. PCT/US2019/066515, filed Dec. 16, 2019.

* cited by examiner

*Primary Examiner* — Matthew Luu
*Assistant Examiner* — Kendrick X Liu
(74) *Attorney, Agent, or Firm* — Hauptman Ham, LLP

(57) ABSTRACT

A holder assembly includes a base, a drive assembly coupled to the base, a motive source connected to the drive assembly, a vertical force applicator connected to the drive assembly along a connection edge thereof, and a gripping member coupled to the base, the gripping member having a contact surface coupled to a vacuum source, wherein the drive assembly has a first position with the flattening member engaged with the contact surface and a second position with the flattening member positioned away from the contact surface.

7 Claims, 13 Drawing Sheets

GRIPPING FOR PRINT SUBSTRATES

CROSS-REFERENCE TO RELATED APPLICATIONS

This application claims benefit of U.S. Provisional Patent Application Ser. No. 62/783,729 filed Dec. 21, 2018, which is incorporated herein by reference.

FIELD

The present disclosure relates to mechanical devices and systems related to manipulating a print substrate during an inkjet printing process.

BACKGROUND

Inkjet printing of large substrates uses grippers and gripper assemblies to manipulate print substrates over a gas cushion table during an inkjet printing process. Accurate and repeatable positioning of a print substrate during a manufacturing process that includes inkjet printing increases the uniformity of dimensions of the material deposited on the print substrate during the manufacturing process.

SUMMARY

Embodiments described herein provide a device, comprising a base; a drive assembly coupled to the base; a motive source connected to the drive assembly; a vertical force applicator connected to the drive assembly along a connection edge thereof; and a gripping member coupled to the base, the gripping member having a contact surface coupled to a vacuum source, wherein the drive assembly has a first position with the flattening member engaged with the contact surface and a second position with the flattening member positioned away from the contact surface.

Other embodiments described herein provide a method of manipulating a substrate, comprising placing the substrate over a gas cushion table, where an edge of the substrate is aligned with a holder assembly along one side of the gas cushion table; bringing a bottom surface of the substrate in vertical proximity to a gripping member of the holder assembly; applying suction through the gripping member; and applying contact force on a top surface of the substrate to engage the substrate with the gripping member.

Other embodiments described herein provide a holder assembly, comprising a plurality of gripping members removably coupled to a receiving surface of a base at a mounting surface of each gripping member, wherein each gripping member includes a ceramic material at a contact surface of the gripping member opposite from the mounting surface, and each gripping member has at least one passage extending through the gripping member.

Other embodiments described herein provide a holder assembly, comprising a base member; a rotary drive assembly coupled to the base member; a motive source connected to the rotary drive assembly; and a gripping assembly coupled to the base member and to a vacuum source, the gripping assembly comprising a stage member and one or more pads.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
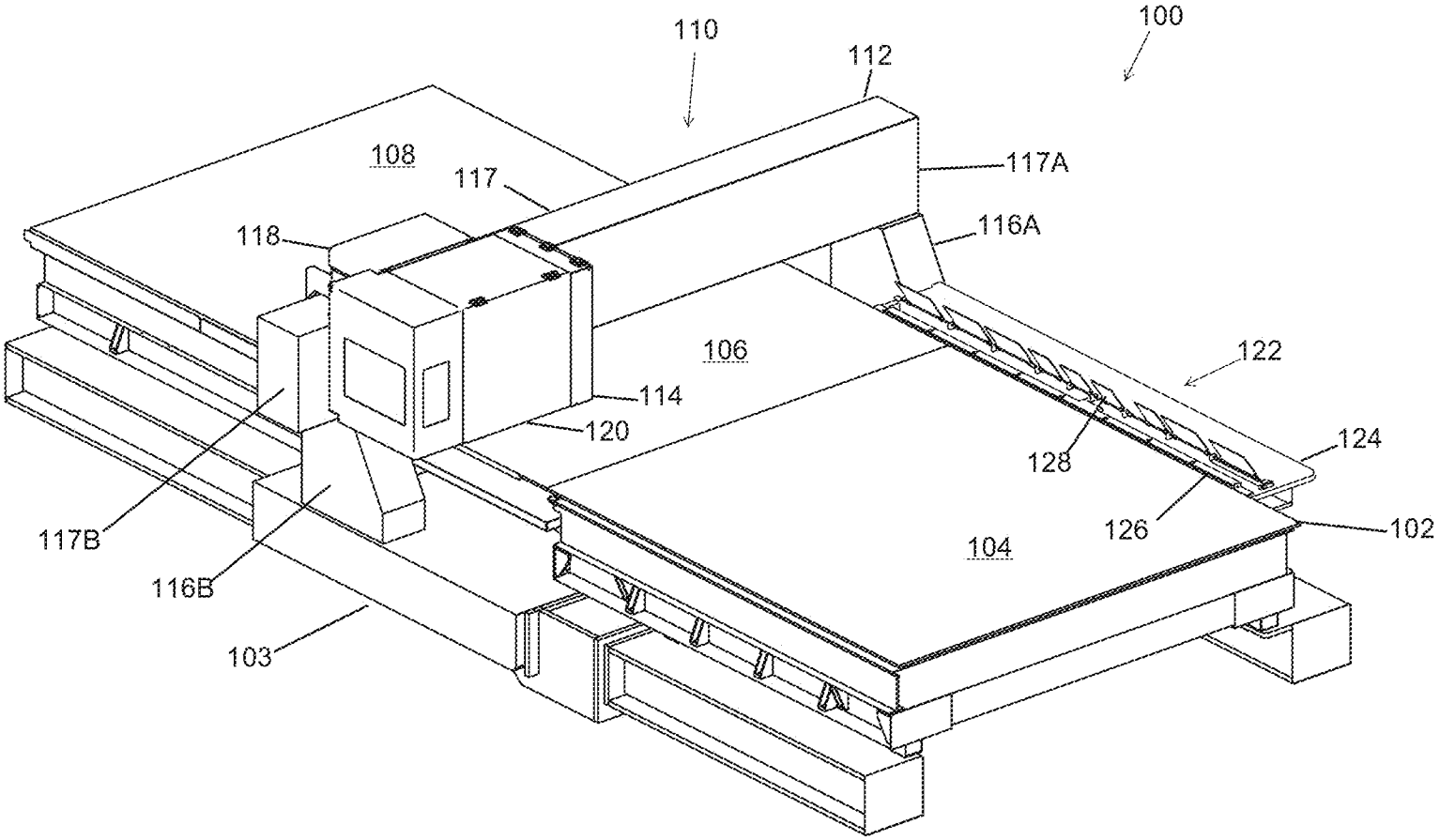
FIG. 1 is an isometric view of an inkjet printing device according to one embodiment.

The following disclosure provides many different embodiments, or examples, for implementing different features of the provided subject matter. Specific examples of components, values, operations, materials, arrangements, etc., are described below to simplify the present disclosure. These are, of course, merely examples and are not intended to be limiting. Other components, values, operations, materials, arrangements, etc., are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The present disclosure relates to devices for, and methods of, handling and manipulating a substrate during a manufacturing process that deposits drops of print material on the substrate surface. In one aspect, the print material is a curable mixture that includes a variety of monomers, quantum dots, scattering particles, and other components suitable for inkjet printing onto the substrate. In the inkjet printing methods described herein, an ejection surface of a print head is positioned a small separation distance from a deposition surface of a substrate during deposition of material from the print head onto the substrate. The separation distance is generally less than 300 micrometer (μm), and in some cases may be as small as 10-50 μm. Variation in the separation distance between the ejection surface and the substrate surface can lead to printing imprecision and faults.

FIG. 1 is an isometric view of an inkjet printing device 100 according to one embodiment. The inkjet printing device 100 includes a gas cushion table 102 with three sections. The first section 104 and a third section 108 have a first pattern of gas distribution holes on the top surface thereof, while a second section 106 includes a second pattern of gas distribution holes on the top surface. The second section 106 is between the first and third sections 104 and 108. The second section 106 defines a work area where deposition on a substrate happens, and the first and third sections 104 and 108 are staging areas for preparing a substrate to move into the work area at the second section 106. The gas cushion table 102 is disposed on a base 103 made of a massive solid object, such as a granite block. The base 103 minimizes unwanted movement of the various printer components due to environmental impulses or vibrations.

A print assembly 110 is juxtaposed with the gas cushion table 102. The print assembly 110 includes a print support 112 and a dispenser assembly 114 coupled to the print support 112. The print support 112 comprises a first stand 116A on one side of the second section 106 of the gas cushion table 102 and a second stand 116B on the opposite side of the second section 106. A rail 117 is disposed with a first end 117A supported by the first stand 116A and a second end 117B opposite the first end 117A and supported by the second stand 116B. The rail 117 extends across the second section 106, and the stands 116A and 116B maintain a constant separation distance of the rail 117 from the gas cushion table 102. The dispenser assembly 114 moves along the rail 117 to position the dispenser assembly 114 to deposit material on a substrate disposed on the second section 106 of the gas cushion table 102.

The dispenser assembly 114 includes a carriage 118 coupled to the rail 117 and a dispenser housing 120 coupled to the carriage. One or more dispensers (not shown) are housed in the dispenser housing 120 to eject print material from ejection surfaces of the dispensers onto the substrate.

A substrate is staged for deposition by disposing the substrate on either the first section 104 or the third section 108 of the gas cushion table 102. The gas cushion table 102 is coupled to a gas source (not shown) to flow gas through openings in the surface of the gas cushion table 102. The gas forms a gas cushion between the surface of the gas cushion table 102 and the substrate disposed thereon, thus supporting the substrate in a non-contact relationship with the gas cushion table. The gas cushion allows the substrate to move along the gas cushion table 102 without friction. A holder assembly 122 attaches securely to the substrate to position the substrate on the gas cushion table 102. The holder assembly includes a base 124, at least one gripping member 126, and at least one flattening member 128.

Figure 2A:
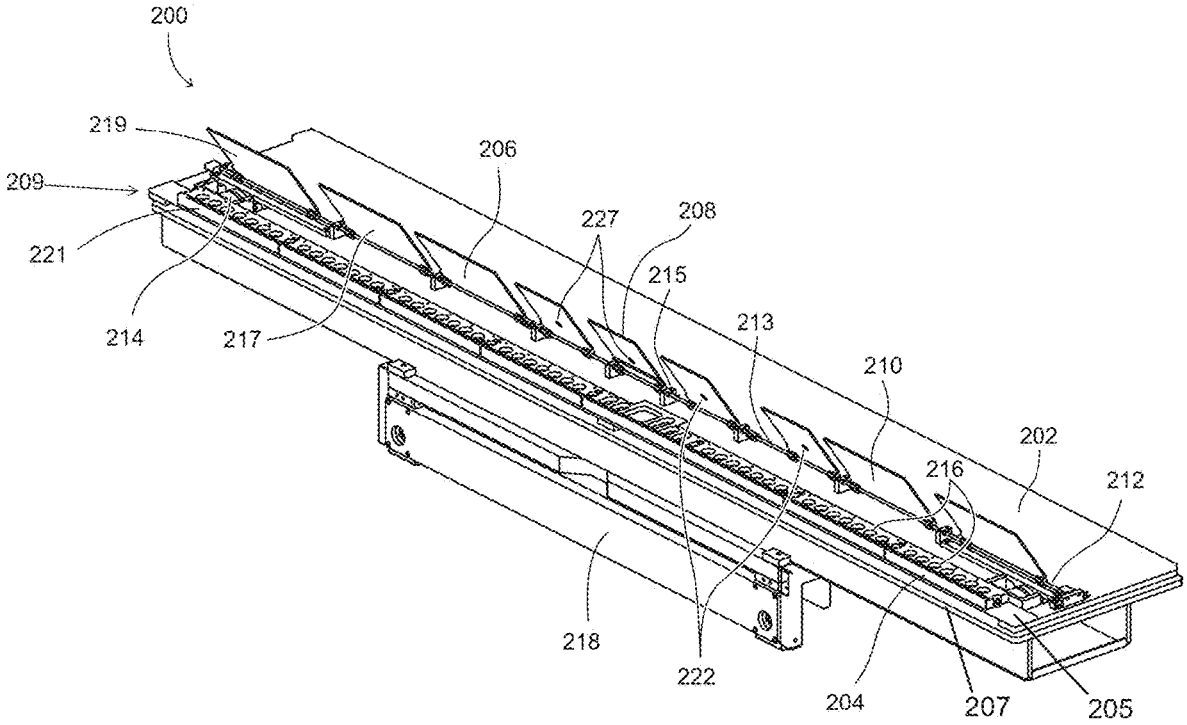
FIG. 2A is an isometric view of a holder assembly according to one embodiment.

FIG. 2A is a schematic diagram of a holder assembly 200 according to one embodiment. The holder assembly 200 may be used as the holder assembly 124 in the device 100 of FIG. 1. The holder assembly 200 has a base member 202 to support and position a plurality of flattening members 206 and a gripping assembly 209 comprising a plurality of gripping members 204. The gripping assembly 209 further comprises a stage member 205, and the gripping members 204 are all coupled to, and supported by, the stage member 205. The stage member 205 is a plate-like member, in this case, that extends along an edge 207 of the base member 202 that is nearest the gas cushion table (102 in FIG. 1). The stage member 205 is coupled to the base member 202 at either end of the stage member 205, and the gripping members 204 are distributed along, and coupled to, the stage member 205. Using multiple individual gripping members on a stage, as described herein, allows for individual alignment and leveling of each gripping member to provide a level surface for engaging substrates. As shown in FIG. 2A, each gripping member 204 is separately fastened to the stage member 205. In this case, each gripping member 204 can be leveled by a leveling mechanism coupled to the gripping member.

Figure 2B:
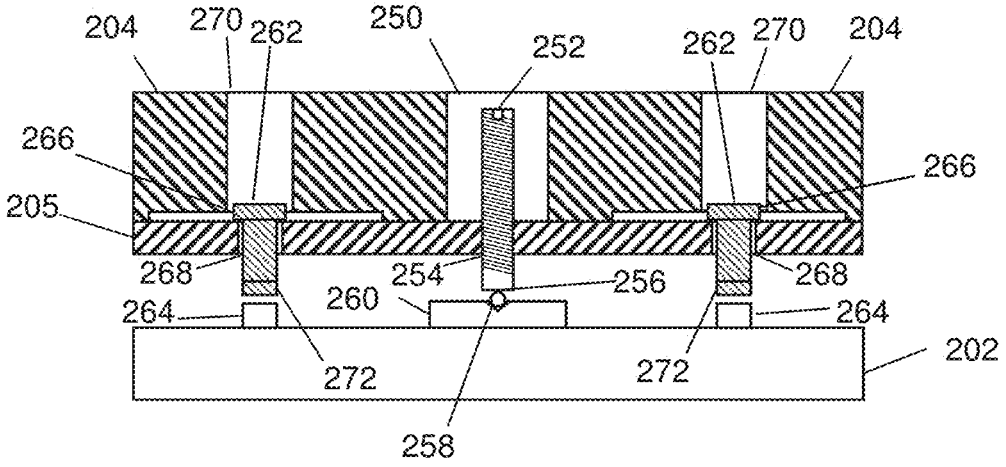
FIG. 2B is a close-up view of two gripping members of FIG. 2A.

In one method, leveling screws are used to level the gripping members 204. FIG. 2B is a close-up view of two gripping members 204 of FIG. 2A. The gripping members 204 together define an opening 250 through which a screw 252 is disposed in a threaded opening 254 of the stage 205. The screw 252 is grounded upon a ball micrometer structure that is a ball 256 in a recess 258 formed in a pedestal 260 attached to the base member 202. The ball micrometer structure maintains a vertical position of the screw 252. Each gripping member 204 has a magnetic restraint 262 disposed in a bore 270 formed through the gripping member 204. The two bores 270 are on either side of the opening 250. Each magnetic restraint 262 is disposed through a hole 268 in the stage 205. A head 266 of each magnetic restraint 262 is larger than the hole 268, so the head 266 engages the stage 205. Each magnetic restraint 262 has a magnetic end member 272 that engages with a ferromagnetic base 264 across a gap to couple a restraining force to the magnetic restraint 262. The restraining force is transmitted to the stage 205 and to the gripping member 204 attached to the stage 205. Adjusting the screw 252 adjusts the position of the stage 205 near the screw 252, which does not change position. In this way, the threaded opening 254 moves axially along the screw, adjusting the elevation of the stage 205, and the portion of the gripping members 204 attached to the stage 205, near the bore 250. Each gripping member 204 has a leveling mechanism of this type at each end. Adjusting the leveling mechanism at each end allows each gripper 204 to be individually leveled. The mechanism illustrated in FIG. 2B is only one way to apply the forces necessary to adjust the level of each gripping member 204. The restraining force can be applied by any mechanism that maintains a restraining force while allowing some shift in position of the gripping members 204. The screw 252 can be based on any suitable structure to maintain the position of the screw 252.

Here, the flattening members 206 are plates coupled to a rotary drive assembly 212 that allows the flattening members 206 to rotate into engagement with the gripping members 204 with a portion of each flattening member 206 adjacent to one or more of the gripping members 204. The rotary drive assembly 212 features a shaft 213 supported by a plurality of supports 215 and extending along a longitudinal axis of the base member 202. The flattening members 206 connect to the rotary drive assembly 212 at a connection edge 217 of each flattening member 206. Here, the shaft 213 is a cylinder with a central axis, and the connection edge 217 of each flattening member 206 is attached to the shaft 213 such that each flattening member 206 extends along a radius of the shaft 213. When the shaft 213 rotates about its central axis the flattening members 206 revolve about the central axis of the shaft 213. At one extreme, the rotary drive assembly 212 has a first rotary position with the flattening members 206 extending over, and engaging with, the gripping members 204. In the first rotary position of the rotary drive assembly 212, a major surface 219 of each flattening member 206 engages with a contact surface 221 of a corresponding gripping member 204. At another extreme, the rotary drive assembly 212 has a second rotary position with the flattening members 206 extending away from the contact surfaces 221. In one aspect, the first rotary position and the second rotary position may define an angle greater than 90°, for example 120°-180°. In most cases, the angle will be at least about 60° to provide clearance for loading and unloading substrates.

The holder assembly 200 includes a motive source 214 coupled to the base member 202 and the rotary drive assembly 212 to position of the flattening members 206. The flattening members 206 are all generally aligned along the same radius of the shaft 213, but some slight variation in alignment may be needed in some cases. The gripping members 204 have one or more openings 216 fluidly coupling the contact surfaces 221 of the gripping members 204, via passages through the gripping members 204 (not shown in FIG. 2), to a vacuum source (not shown) that securely attaches a substrate to the contact surfaces 221 by suction. The contact surfaces 221 thus function as gripping surfaces to apply a gripping force to a substrate. The gripping members 204 are thus pads for acquiring a secure hold on a substrate using suction.

When a substrate is positioned for attachment to the gripping members 204, non-flatness of the substrate can prevent secure attachment by application of suction. In this embodiment, the flattening members 206 are rotated by moving the rotary drive assembly 212 into the first rotary position. In other embodiments described below, the flattening members move linearly to engage the gripping members. The major surfaces 221 of the flattening members 206 contact a top surface of the substrate, applying contact pressure to the top surface of the substrate. The flattening members 206 are thus contact force members movably coupled to the base member 202 with a first position having a portion of each contact force member positioned adjacent to the gripping members 204 and a second position having the portion of each contact force member positioned away from the gripping members 204. The rotary drive assembly 212 is actuated with enough force, and the flattening members 206 are structurally strong enough to transmit enough force, to the top surface of the substrate to flatten the substrate against the contact surfaces 221 of the gripping members 204 such that application of suction at the contact surfaces 221 will acquire secure attachment between the contact surfaces 221 and the substrate. The flattening members 206 are thus vertical force applicators that apply vertical contact force to the substrate to ensure acquisition of a secure suction grip on the substrate. Suction may be applied prior to deployment of the rotary drive assembly 212 to the first rotary position, or afterward.

According to some embodiments, the flattening members 206 are made of an elastically deformable material such that when the flattening members 206 are rotated from an open, non-contact position, with the rotary drive assembly 212 in the second rotary position, to a closed, contact position, with the rotary drive assembly 212 in the first rotary position, the flattening members 206 may come into contact with the surface of the substrate before the rotary drive assembly 212 reaches the first rotary position. At that time, as the rotary drive assembly 212 continues to move to the first rotary position, the flattening members 206 may deform slightly. Use of flexible flattening members 206 allows for development of a selectable shear force within the flattening members 206, with the rotary drive assembly 212 positioned at the first rotary position, such that the contact pressure applied to the top surface of the substrate may be selected by pre-shaping the flattening members 206. In this way, if substrates generally have a systematic deformation when loaded into the printing device, the flattening members 206 can be shaped to provide more contact force where deformation is greater and less contact force where deformation is less.

The flattening members 206 may be made or, or may comprise, a resin or plastic material that has been machined or molded to have a flat surface that presses on a top surface of a print substrate. Materials that may be used include polyurethane, polyethylene, polypropylene, polyimide, polyether ether ketone (PEEK), polyacrylates, olefin-acrylate copolymers, and vulcanizable olefin-diolefin copolymers such as styrenic diene copolymers.

The flattening members 206 all have a width, measured along the longitudinal axis of the holder assembly 200, parallel to the connection edge 217. The width of the flattening members 206 may be the same, or different one from the other. As shown in FIG. 2, the flattening members 206 are in two groups. A first plurality of flattening members 206 has a first width, and a second plurality of flattening members 206 has a second width different from the first width. Here, the first width is greater than the second width, and the first plurality of flattening members is divided into two portions located on either side of the second plurality of flattening members. In other cases, a first flattening member at a first end of the shaft 213 has a first width, a flattening member at a second end of the shaft 213 opposite from the first end has a second width greater than the first width, and the flattening members between the first second flattening members have monotonically increasing width from the first end toward the second end of the shaft 213.

Further, the flattening members 206 may all have the same length, transverse to the width defined above, or may have different lengths one from the other. Here, the flattening members 206 all have the same length, but flattening members 206 can be used that have length less than the flattening members 206 shown in FIG. 2, which may be attached to the shaft 213 by one or more rods or tabs. For a flattening member attached to the shaft 213 by a tab, the flattening member effectively has two portions with two different widths, a first portion with a first width and a second portion with a second width greater than the first width, and the connection edge of the flattening member is at one side of the first portion thereof. In other embodiments, the greater width is at the connection edge, as shown and explained further below.

In the embodiment of FIG. 2, some of the flattening members 206 have holes 222. One or more flattening members of a holder assembly may have a hole, or more than one hole, to prevent substantially pressure change between the flattening member 206 and the substrate as the flattening member is applied to the substrate and withdrawn from the substrate. The hole allows gas to escape as the flattening member approaches the substrate and to ingress as the flattening member retracts from the substrate. Holes may be used when the portion of the substrate addressed by the flattening member is typically flat and pressure changes are expected. All the flattening members 206 may have holes, or only a few as shown in FIG. 2, or only one in some cases. In the embodiment of FIG. 2, the flattening members 206 are generally configured to address substrates with more prior deformation at the ends and corners of the substrate than in central areas, so the flattening members addressing the central area of the substrate are configured with holes.

Figure 3:
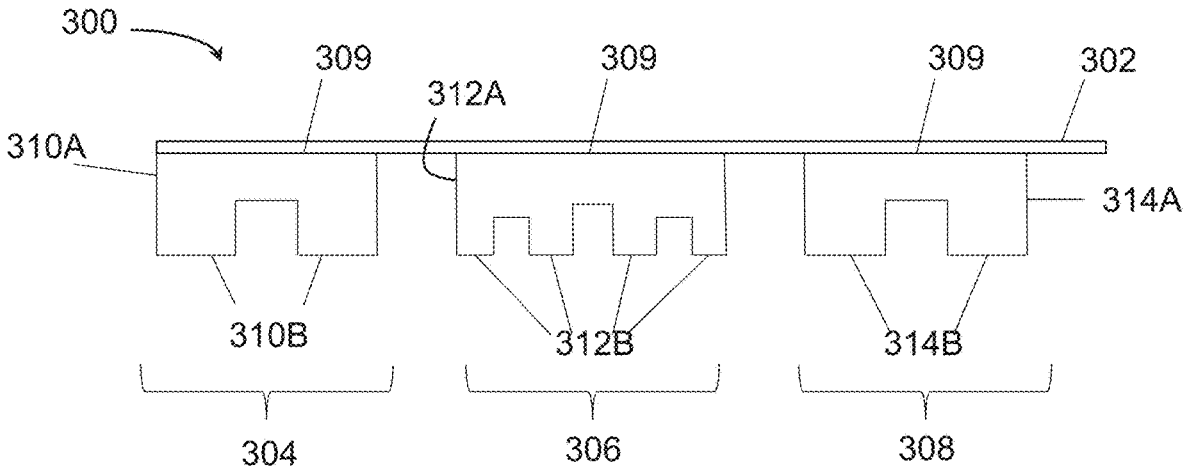
FIG. 3 is a top view of a flattener assembly, according to one embodiment.

FIG. 3 is a schematic diagram of a flattener assembly 300 according to one embodiment. The flattener assembly 300 is another embodiment that may be used with the holder assembly 200 or the holder assembly 124. The flattener assembly 300 includes a shaft 302, to which three flattening members 304, 306, and 308 are attached at a connecting edge 309 of each. Flattening member 304 includes a spine 310A and two fingers 310B, flattening member 306 includes a spine 312A and four fingers 312B, and flattening member 308 includes a spine 314A and two fingers 314B. In each flattening member 304, 306, and 308, the spine thereof has a first width and the fingers have a second width, the second width being less than the first width. The connection edge 309 of each flattening member 304, 306, 308, is an extremity of the spine thereof, so in these examples the greater width of the flattening members is at the connection edge thereof. As shown here, any number of fingers can be used for a flattening member, and the fingers of one flattening member may all have the same length or may have different lengths, and may all have the same width or different widths. The length and width of each finger can be selected to provide a desired force-deformation profile so that a predetermined contact force profile can be applied to the substrate when the flattening members are deployed.

Figure 4A:
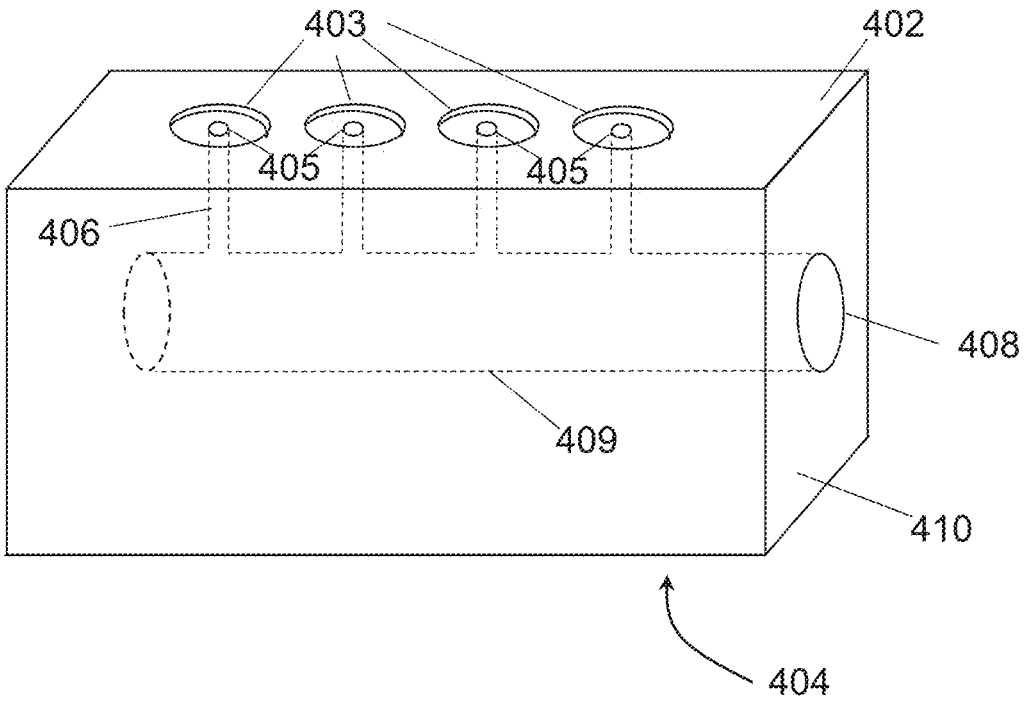
FIGS. 4A-4G is a top view of a flattener assembly, according to another embodiment.

FIG. 4A is an isometric view of a gripping member 400 according to one embodiment. The gripping member 400 may be used in the printing device 100 of FIG. 1. The gripping member 400 is made of an inorganic material to provide structural stability and dimensional control during thermal cycling. The gripping member 400 has a contact surface 402 on one side and a mounting surface 404 on an opposite side thereof. Thus, the gripping member 400 is a pad where a substrate is held securely for processing. A plurality of recesses 403 are formed in the contact surface 402. An opening 405 of contact surface 402 is provided in the floor of each recess 403 to fluidly couple each contact surface 402 recess 403 to passages 406 extending into the gripping member 400 from the contact surface 402 floor of each recess 403. Each pair of passages 406 and recesses 403 forms a passage extending from the contact surface into the gripping member and having a diameter that varies along a length of the passage. The diameter of the passage is larger at the recess 403 portion of the passage and smaller at the interior portion of the passage represented by the passage 406. A side surface 410 of the gripping member 400 joins the contact surface 402 and the mounting surface 404. In some embodiments, the side surface 410 has an opening 408 that couples the side surface 410 to a passage 409 extending from side surface 410 into the gripping member 400 to connect with the passages 406. In some embodiments, one recess 403 in the contact surface 402 may occupy most of the area of the contact surface 402, with multiple passages 406 in the recess 403. In such cases, the gripping member 400 can be a suction cup that securely holds a substrate against the contact surface 402.

The contact surface 402 of a gripping member, as described herein, is generally made of a material having a surface resistivity that minimizes effects of static electricity when processing a substrate. The contact surface 402 is an exposed material having a surface resistivity in a range of $10^6$ to $10^9$ Ohms-sq. In some embodiments, the contact surface 402 has surface resistivity in a range of $10^6$ to $10^{12}$ Ohms-sq. The contact surface 402 may be ceramic with Vickers hardness greater than 900 HV. The surface resistivity of the contact surface 402 leads to a low level of electrostatic discharge potential.

Figure 4B:
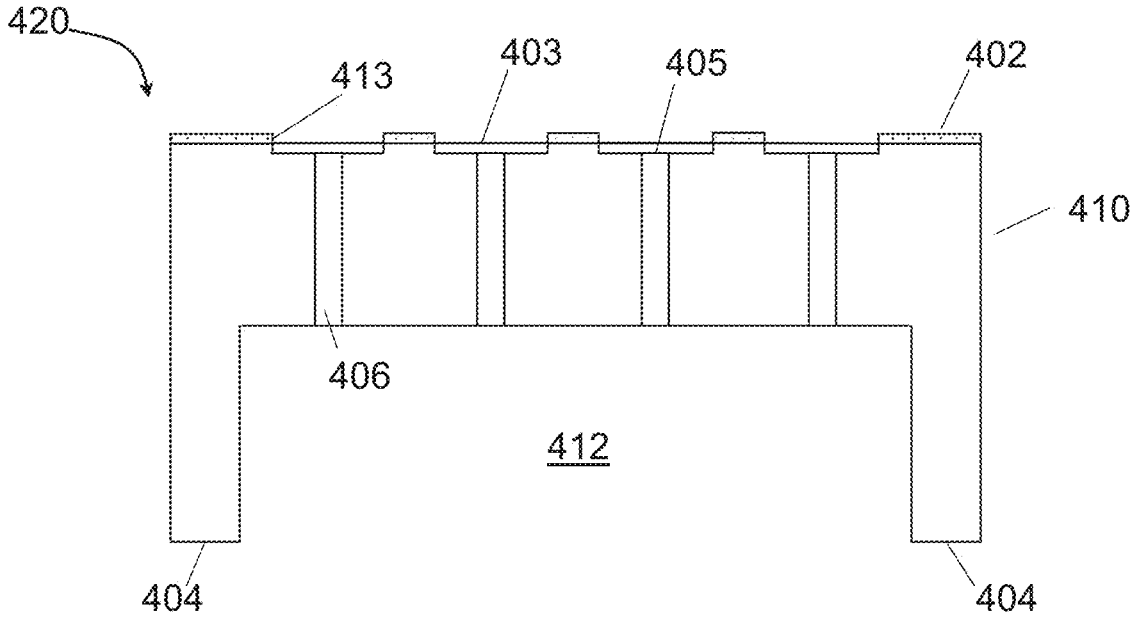

FIG. 4B is a cross-sectional view of a gripping member 420, according to another embodiment, at a longitudinal section plane. The gripping member 420 has a contact surface 402 and mounting surface 404, similar to the gripping member 400 in FIG. 4A, with recesses 403 in the contact surface 402. Passages 406 extend from openings 405 at the floor of the recesses 403 to a recess 412 formed in the mounting surface 404. The recess 412 extends from mounting surface 404 to an interior portion of gripping member 400. In this case, the recess 412 couples suction provided from a vacuum source (not shown) through a holder assembly or a gripper base (such as the base member 202) to the passages 406. Here, the recess 412, passage 406, and recess 403 forms a passage from the contact surface 402 to the mounting surface 404 of the gripping member 420 having a diameter that varies from a first diameter at the recess 403, to a second diameter at the passage 406, to a third diameter at the recess 412. Here, the third diameter is larger than the first diameter, which is larger than the second diameter.

The contact surface 402 may include a coating or layer 413. The layer 413 is made of a material having the electrical properties described above. In such cases, the body of the gripping member 420 can be made of a different material. The layer 413 may be a ceramic material, such as metal oxide, for example alumina, and may be from a few microns up to 5 mm thick. The layer 413 may be porous to provide some fluid communication through the material of the layer 413 such that the suction force applied through the passages 406 can spread through the layer 413 to apply a broader gripping force to a substrate. A ceramic material used for any portion of a gripping member as described herein can be anodized metal, or may be formed by other processes such as vapor deposition, for example by reactive or non-reactive sputtering. Ceramic materials can be, or can include metal oxides. Ceramic materials can be mixtures of metal oxides with other materials, metal, non-metal, or metalloid. For example, a ceramic material can be a mixture of metal oxide and non-metal oxides such as semiconductor oxides. Ceramics can also include nitrides such as metal and semiconductor nitrides. Carbon can also be included in some ceramic materials.

Figure 4C:
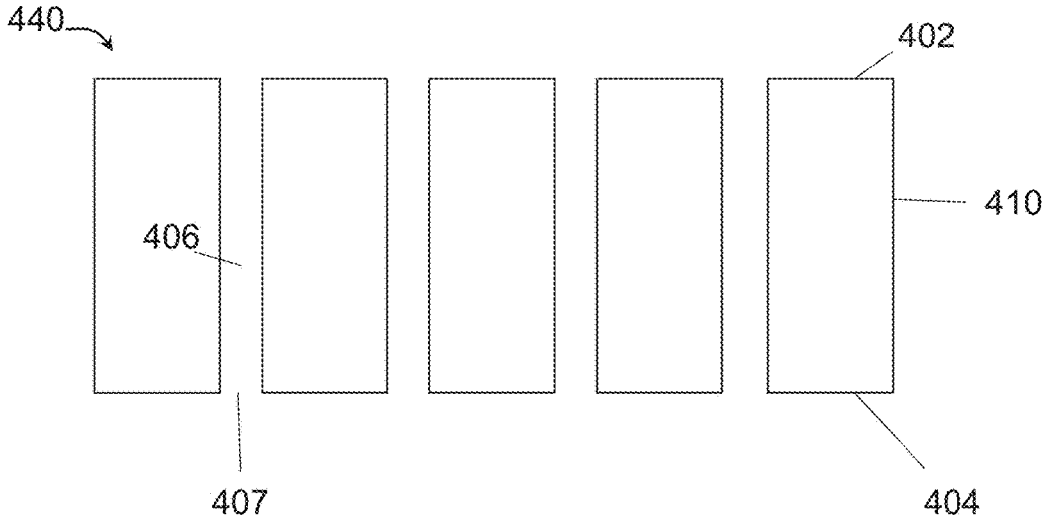

FIG. 4C is a cross-sectional view of a gripping member 440, according to another embodiment, at a longitudinal section plane. Gripping member 440 has contact surface 402, mounting surface 404, and passages 506 extending through the gripping member 440 from the contact surface 402 to the mounting surface 404. Here, each passage 406 connects an opening 405 with a corresponding opening 407 in the mounting surface 404, with no recesses formed in the contact surface 402. In the gripping member 440, the passages 406 have a constant diameter and extend from the contact surface 402 to the mounting surface 404 without joining, and without encountering side surface 510.

Figure 4D:
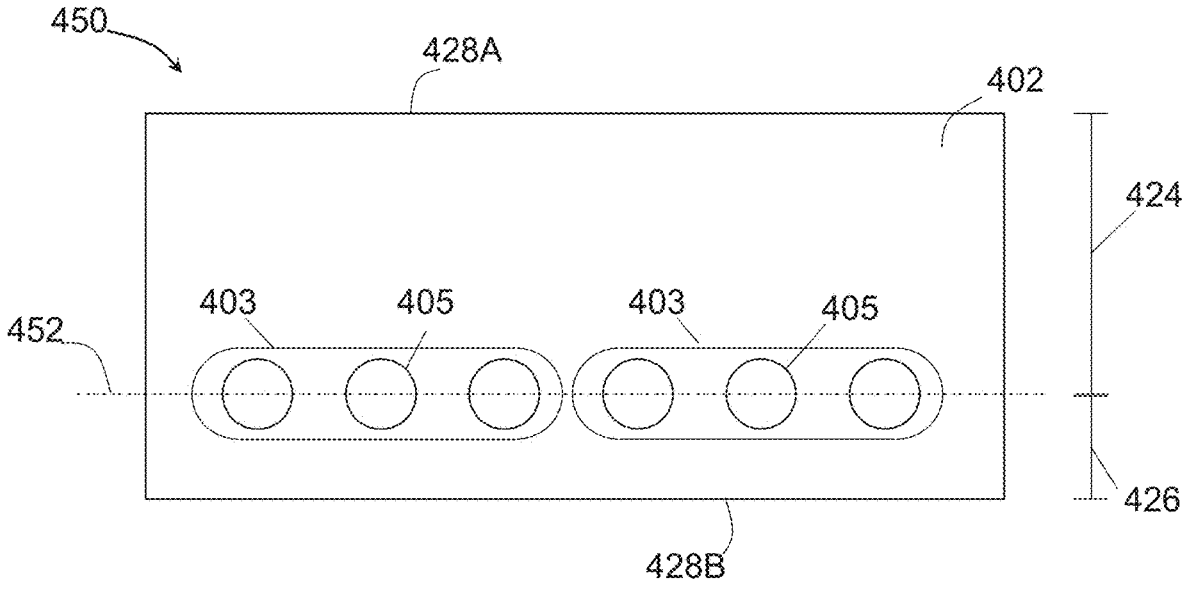

FIG. 4D is a top view of a gripping member 450 according to another embodiment. Gripping member 450 has a contact surface 402, into which a plurality of openings 405 are formed to connect to passages (not shown) within the gripping member 450. The openings 405 are grouped into two groups and disposed in recesses 403 formed in the contact surface 402. A first recess 403 has a first plurality of openings 405 and a second recess 403 has a second plurality of openings 405. The openings 405 are positioned in the recesses 403 at the contact surface 402 to optimize application of the gripping member 450 to substrates when positioning of the substrate may be somewhat imprecise.

The openings 405 are arranged along a longitudinal line 452 along the contact surface 402, where here the line passes through the center of each opening 405. In this case, the line 452 is a first distance 424 from a first edge 428A of the contact surface 402 and a second distance 426 from a second edge 428B of the contact surface 402 opposite from the first edge 428A. The first and second distances 424 and 426 may be the same (as shown in FIG. 4A) or different, as shown here. In cases where the first and second distances 424 and 426 are different, for example as shown here with the second distance 426 less than the first distance 424, the gripping member 450 can be arranged with the second edge 428B proximate to the gas cushion support 102 (FIG. 1) such that an edge of the substrate extends across the openings 450 to a position near the first edge 428A of the contact surface 402 such that the edge of the substrate is not close to an opening 405 to break the suction hold. In this way, imprecision in positioning of the substrate does not lead to attachment failures.

Figure 4E:
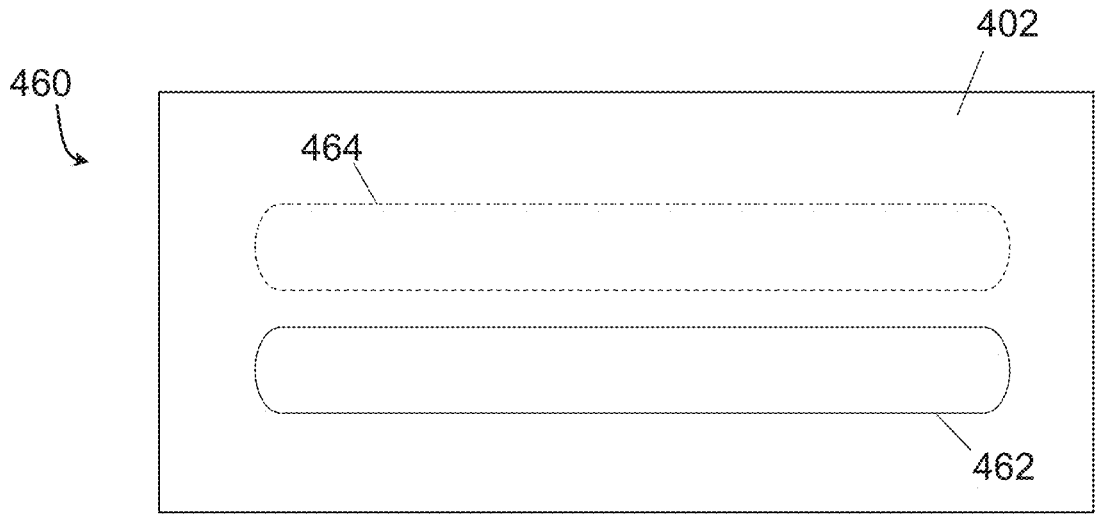

FIG. 4E is a top view of a gripping member 460 according to another embodiment. An opening 462 in the contact surface 402 extends into the gripping member 460. The opening 462 is a longitudinally elongated opening. In some cases, an optional second opening 464, longitudinally elongated like the opening 462 and adjacent thereto, is also provided. In the gripping member 460, the openings 462 and 464 have the same shape, but the multiple openings can have different shapes. For example, the longitudinally elongated opening 462 can be accompanied by two or more shorter longitudinally elongated openings arranged along a line adjacent to the opening 462. In other cases, the opening 462 can be accompanied by a row of circular openings arranged along a line adjacent to the opening 462.

Figure 4F:
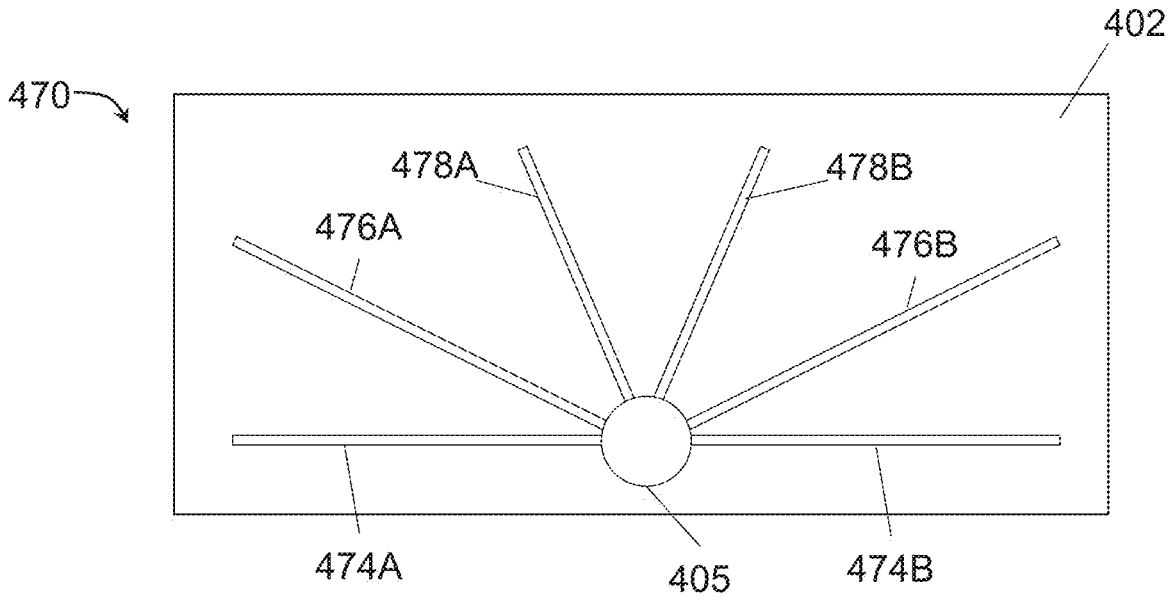

FIG. 4F is a top view of a gripping member 470 according to another embodiment. In this case, contact surface 402 has an opening 405 connecting to a passage (not shown) extending into the gripping member 470. A plurality of channels 474A-B, 476A-B, and 478A-B extend across the contact surface 402 and connect to the opening 405. Channels can be provided across a contact surface 402 to extend suction force across the bottom surface of a substrate engaged with the contact surface 402 while using a single opening 405 and corresponding passage within the gripping member 470. Any pattern of channels can be used, and the channels can have varying density, length, and width to optimize distribution of suction force across the bottom surface of the substrate. In this case, channels 474A-B, 476A-B, and 478A-B have the same width, which is constant, and radiate outward from the opening 405 across the contact surface 402. In this embodiment, no recess is provided for the opening 405, but in an alternate embodiment the opening 405 could be disposed in a recess formed in the contact surface 402, and the channels 474, 476, and 478 could radiate from the recess.

Figure 4G:
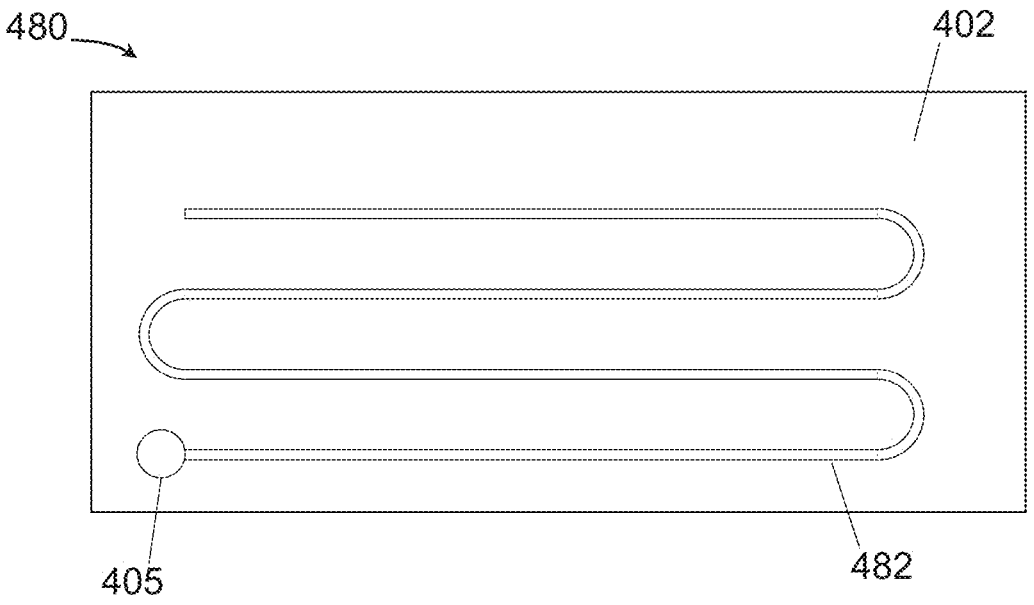

FIG. 4G is a top view of a gripping member 480 according to another embodiment. Here, the opening 405 is positioned in a corner of the contact surface 402, over a passage (not shown) into the gripping member 480. A single channel 482 is connected at one end thereof to the opening 405 and extends outward from the opening 405 across the contact surface 402. The channel 482 is a serpentine channel crisscrossing the contact surface 402 in a boustrophedonic pattern. In other embodiments, both ends of the channel 482 may connect to an opening 405 in the contact surface 402. In other cases, multiple channels may connect to openings at both ends. In the case of serpentine channels, the serpentine pattern may be oriented along the longitudinal axis of the gripping member, as shown in FIG. 4G. In other cases, the serpentine pattern may be oriented transverse to the longitudinal axis, or at an angle to the longitudinal axis.

The depths and widths of channels across the contact surface 402 are not always identical or constant. Channel depth and/or width can vary to adjust magnitude of the local suction force, for example by modulating the area across which the suction force is applied locally.

Figure 5A:
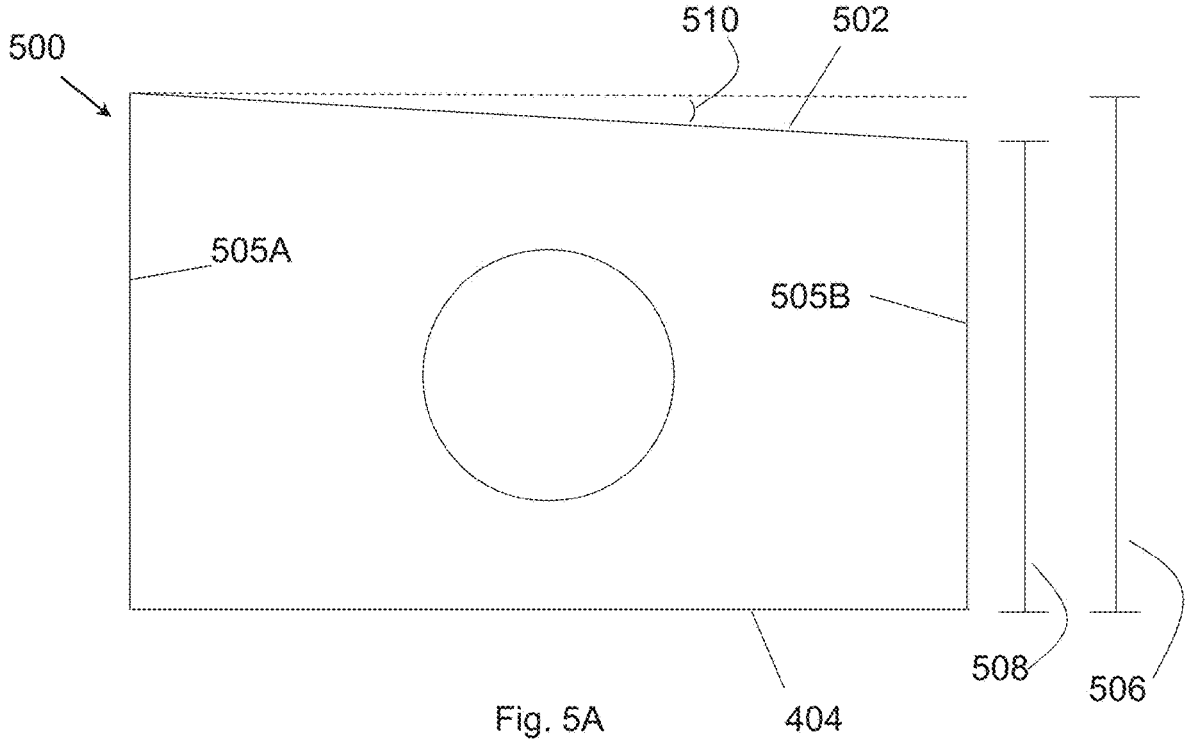
FIGS. 5A-5B are views of two gripping member embodiments.

FIG. 5A is a side view of a gripping member 500 according to one embodiment. The view of FIG. 5A is along the longitudinal axis of the gripping member 500. The gripping member 500 has a contact surface 502 and mounting surface 504 on the opposite side. In this case, the contact surface 502 is not parallel to the mounting surface 504. In other words, a plane defined by the contact surface 502 and extending along the contact surface 502 intersects with a plane defined by, and extending along, the mounting surface 504. A first side 505A of the gripping member 500 connects the contact surface 502 with the mounting surface 504 and has a first height 506. A second side 505B of the gripping member 500, opposite from the first side 505A, also connects the contact surface 502 with the mounting surface 504 and has a second height 508 different from the first height. Thus, the contact surface 502 is sloped with respect to the mounting surface 504. Depending on the configuration of the holder assembly and the gas cushion table, the gripping member 500 may be installed with the first side 505A or the second side 505B nearest the gas cushion table to optimize handling of a substrate on the gas cushion table. The contact surface 502 of the gripping member 500 forms an angle 510 with a horizontal surface, which is substantially parallel to the mounting surface and/or the surface of the gas cushion table. In most cases the angle 510 ranges from 0° to not more than 3°. Use of a sloped surface can improve uniformity in the gap between the print surface of the substrate and the ejection surface of the dispensers.

Figure 5B:
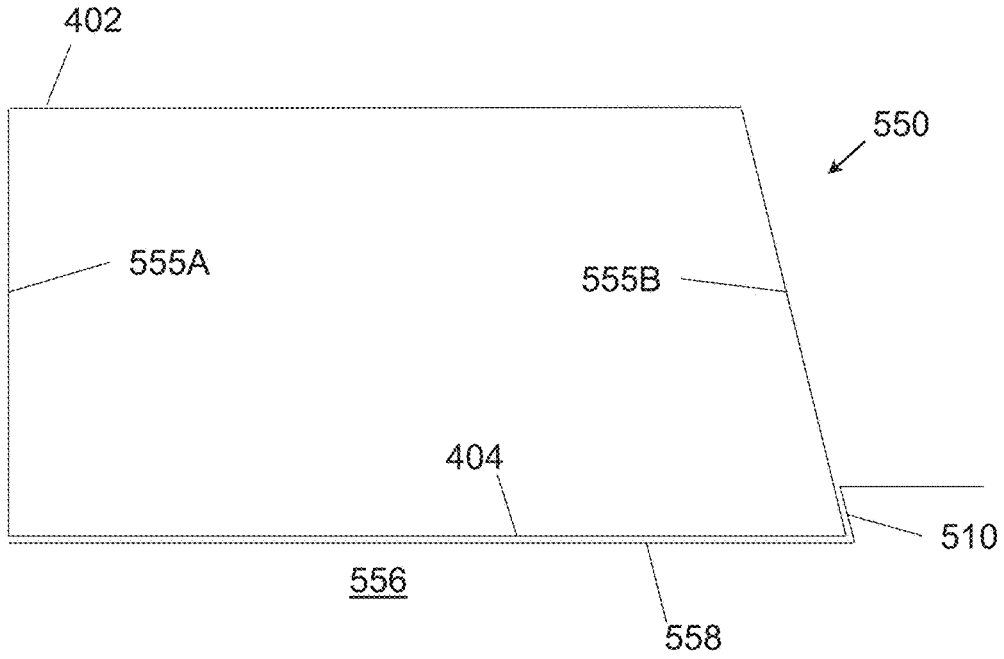

FIG. 5B is a cross-sectional diagram of a gripping member 550 according to another embodiment. The gripping member 550 has a contact surface 402 and a mounting surface 404 opposite the contact surface 402. A first side 555A of the gripping member 550 connecting the contact surface 402 with the mounting surface 404 is opposite a second side 555B of the gripping member 550 connecting the contact surface 402 with the mounting surface 404. Here, the first and second sides 555A and 555B are not parallel. The second side 555B forms an angle less than 90° with the mounting surface 404 in this case. A base member 556 is shown in operative relation to the gripping member 550. The base member 556 has a receiving surface 558 and a wall 510. The wall 510 and receiving surface 558 form an angle that matches the angle of the first and second sides 555*a* and 555B in this case. In other cases, the angle of the base member 556 may be larger than the angle of the first and second sides 555A/B. The gripping member 550 may be retained against the wall 510 using any convenient means, for example a set screw. The structure of FIG. 5B provides reliable alignment of the gripping member 550 with the base member 556.

Figure 6:
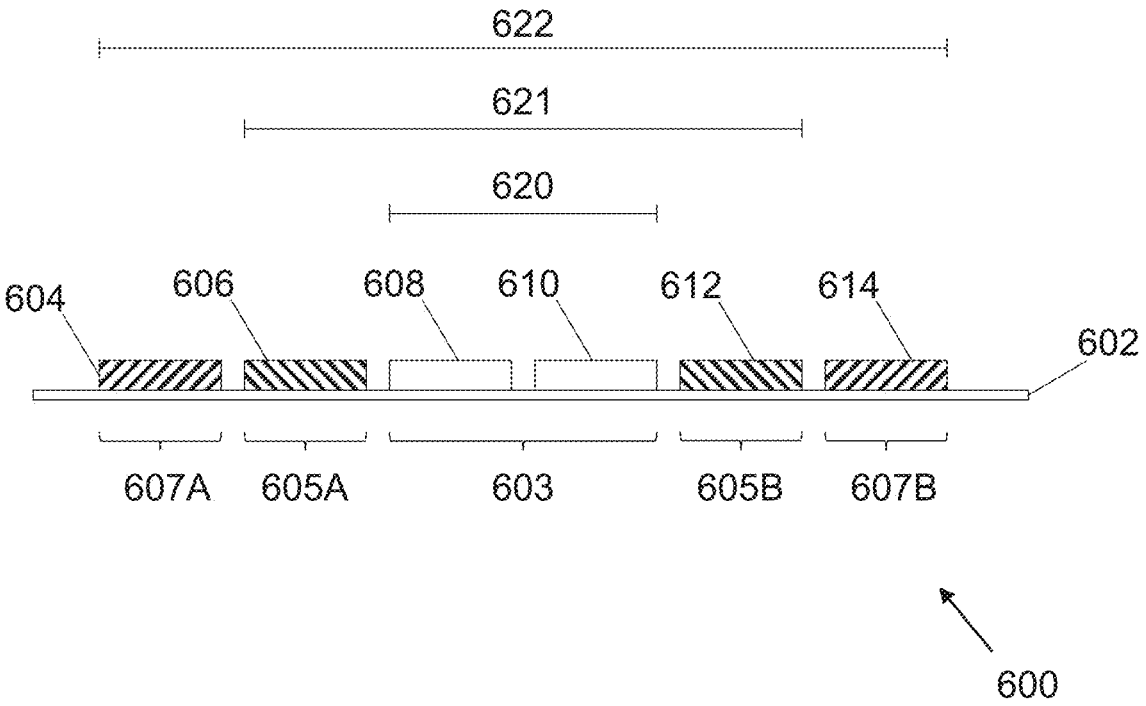
FIG. 6 is a cross-sectional view of a gripping member according to another embodiment.

FIG. 6 is a schematic side view of a gripping assembly 600 according to one embodiment. The gripping assembly 600 may be used as the gripping assembly 209 in FIG. 2. A base member 602 is coupled to a plurality of gripping members and optionally blanks. A blank is a piece of material having similar dimensions to a gripping member, but lacking passages through the body thereof or any means to apply suction, or other gripping force, to a substrate. Use of gripping members and blanks allows optimization of the geometry of suction to apply to various substrates. Here, a first region 603 of the base member 602 is fitted with gripping members 608 and 610 to match a substrate with a first width 620 while segments 604, 606, 612, and 614 are blanks. If a substrate having a second width 621 is to be used, regions 603 and 605A-B can be fitted with gripping members (e.g. segments 606, 608, 610, and 612 would be gripping members) and regions 607A-B are fitted with blanks (e.g. segments 604 and 614 would be blanks). If a substrate having a third width 622 is to be used, regions 603, 605A-B, and 607A-B can be fitted with gripping members (e.g. segments 604, 606, 608, 610, 612, and 614 would be gripping members) and other segments on the base member 602, if any (none are shown) are blanks. Thus, a holder assembly using segmented gripping members provides flexibility to accommodate substrates of different sizes, and reduces the cost of replacing gripping members. Different gripping members can also be used having different flow characteristics for different suction profiles, if desired.

Description of gripping members given above describes the shapes and structural features of gripping members in a holder assembly. An additional aspect of gripping assemblies is the selection of materials used for the gripping members. In some instances, gripping members are made by machining metal blocks in order to create gripping members with structural stability and precise dimensions suitable for positioning a substrate 10-50 μm from an ejection surface of an inkjet dispenser. Metal blocks are suitable for meeting such dimensional tolerances in many cases. Metal oxides or other ceramic materials are also suitable for meeting such dimensional tolerances in many cases. In one example, a gripping member may be, or may comprise, a machined aluminum block that has been oxidized by exposure to air, or anodized to deliberately grow a layer of aluminum oxide (AL2O3) on an outer surface thereof. Gripping members can a machined block of solid aluminum oxide, in some cases. In other instances, a gripping member is made by machining a block of fused aluminum oxide particles. Although aluminum and aluminum oxide are discussed above as exemplary materials for making gripping members, other materials, such as titanium, iron, copper, zinc, magnesium, and alloys and oxides thereof, can also be used.

Further, other embodiments of gripping members are made from more complex ceramic materials than simple metal oxides, including borosilicates, quartz, and other ceramic materials. The dimensions and shapes of gripping members, and materials used to make the gripping members, are adjusted in some cases to accommodate thermal cycling of the gripping members during a manufacturing process. In other cases, materials are selected to avoid any thermal effect of the gripping member on the substrate. For example, gripping members with large recesses have less thermal mass and will therefore have less thermal effect on a substrate.

Some embodiments of gripping members include thin layers of slip resistance coatings or slip resistant fixtures applied to an outer surface, especially the contact surface, of the gripping member. Slip resistant features, when used, provide additional security to reduce and/or eliminate unanticipated movement of a substrate against the contact surface during operation.

Figure 7:
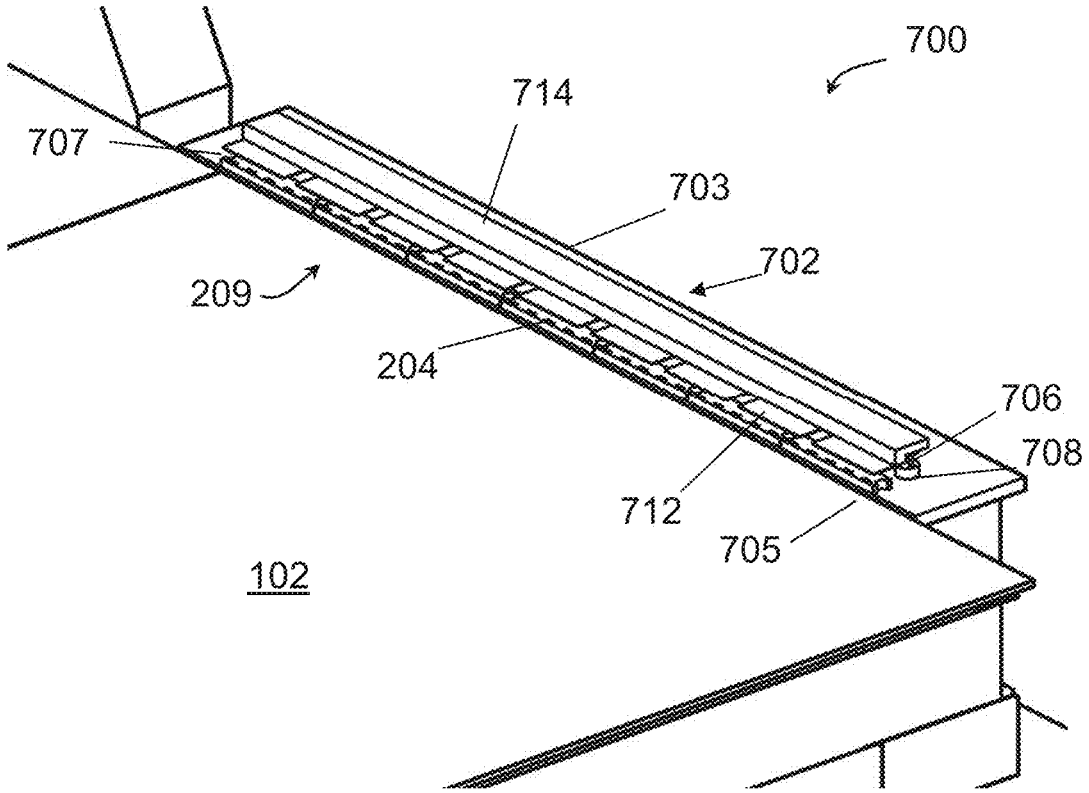
FIG. 7 is a close-up isometric view of an inkjet printing device according to one embodiment, focused on the holder assembly.

FIG. 7 is an isometric view of an inkjet printing device 700 according to another embodiment, focused on the holder assembly. The inkjet printing device 700 is similar in many respects to the inkjet printing device 100 of FIG. 1. The chief difference between the device 700 and the device 100 is that the device 700 includes a holder assembly 702 with a linear drive assembly and a motive source that includes a linear actuator 706. The linear drive assembly includes a support 708 attached to the base member 703 of the holder assembly 700 and extending to an engagement position relative to the gripping members 204. The linear actuators 706 are coupled to the support 708 as the motive source, and each linear actuator is disposed such that an axis of movement of the linear actuator 708 is in a direction perpendicular to the plane defined by the substrate support 102. One linear actuator 706 is visible in FIG. 7 at a first end 705 of the gripping assembly 209, and another linear actuator is located at a second end 707 of the gripping assembly 209 opposite from the first end 705. The linear drive assembly includes one or more flattening members 712 coupled to the linear actuators 706. In alternate embodiments, one linear actuator 706 may be used. The linear drive assembly may include a coupling member 714 to couple the flattening members 712 to the linear actuators 706. Here, the coupling member 714 extends between the two linear actuators 706, and the flattening members 712 are coupled to the coupling member 714. In this case, the flattening members 712 are leaf springs that extend from the coupling member 714 to engage with the gripping members 204. When a substrate is disposed on the inkjet printing device 700 for processing, the substrate is positioned to engage with the gripping members 204. With the substrate so positioned, the linear actuators 706 are energized to move to a first position with the flattening members 712 in contact with the substrate, pressing the substrate toward the gripping members 204. Suction is activated to acquire secure contact between the gripping members 204 and the substrate. The linear actuators 706 are then energized to move the flattening members 712 to a second position away from the substrate. Here, the support 708 is attached to the base member 202, such that as the holder assembly 702 is moved, the support 708, linear actuators 706, flattening members 712, and coupling member 714 move with the holder assembly 702.

Figure 8:
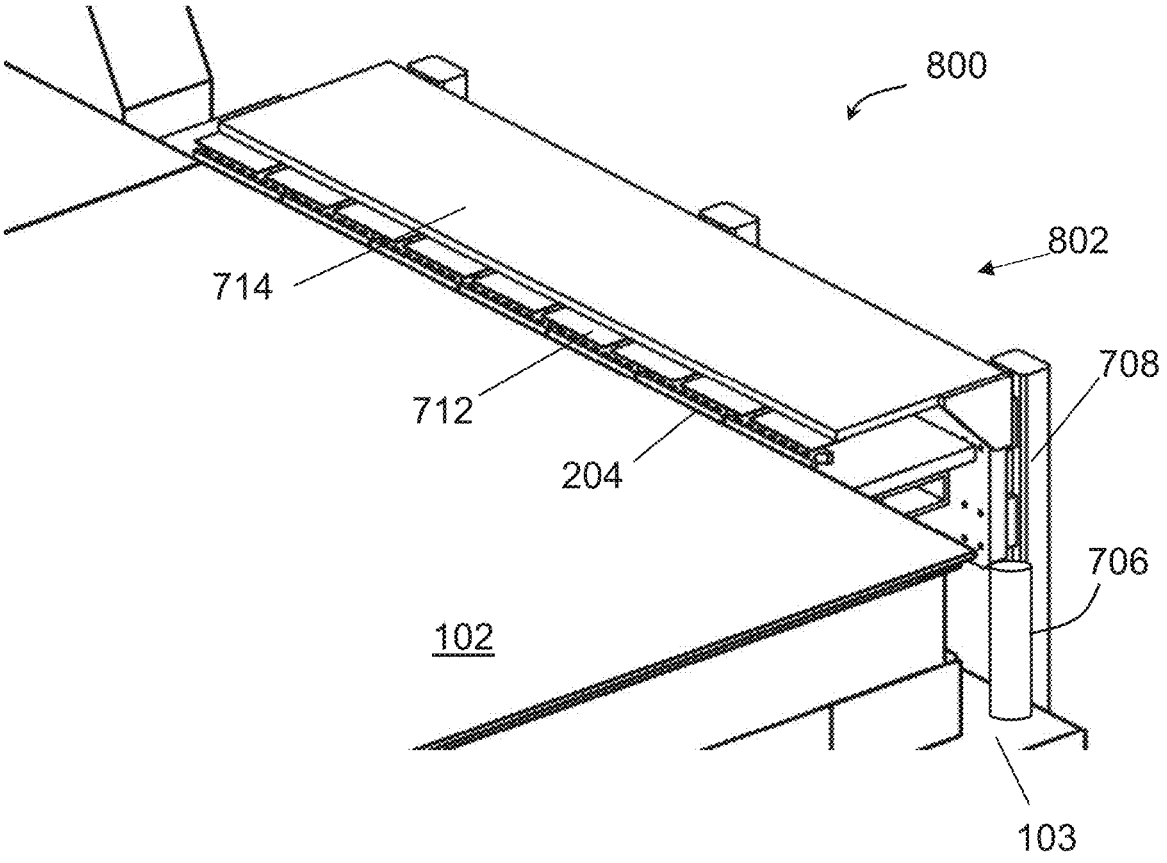
FIG. 8 is a close-up isometric view of another inkjet printing device focused on the holder assembly.

FIG. 8 is an isometric view of an inkjet printing device 800 according to another embodiment. The inkjet printing device 800 is similar in many respects to the inkjet printing devices 100 and 700. The chief difference between the device 800 and the device 700 is that the support 708 is attached to the base 103. In this case, the device 800 has a holder assembly 802 with no flattening device, such that the holder assembly 802 merely holds and translates the substrate. The support 708, linear actuators 706, flattening members 712, and coupling member 714 do not move with the holder assembly 802. Thus, to attach the substrate to the holder assembly 802, the holder assembly 802 moves to a position in registration with the flattening members 712, and the linear actuators 710 deploy to engage the substrate with the gripping members 204.

Figure 9:
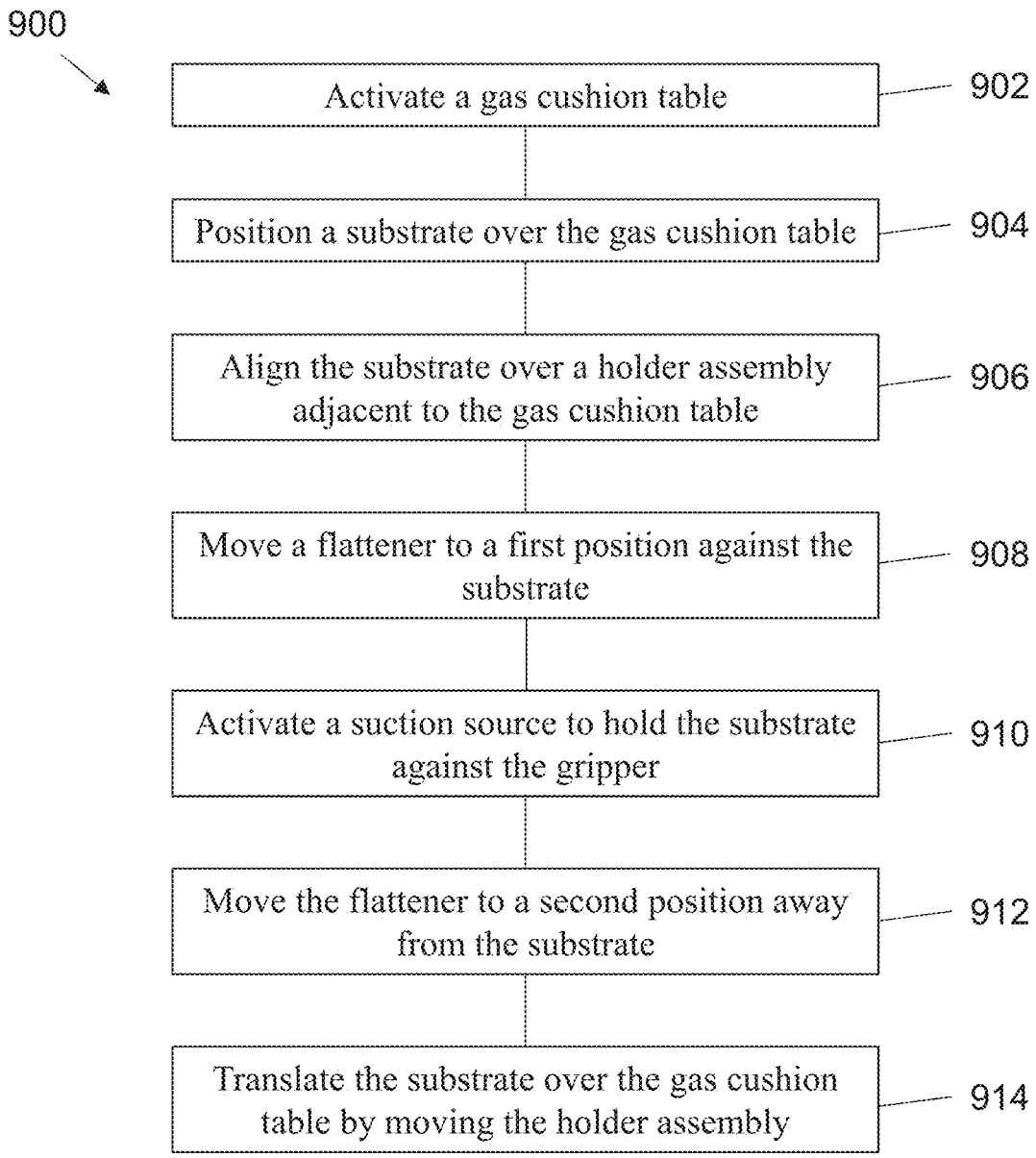
FIG. 9 is a flow diagram of a method of using a holder assembly, in accordance with some embodiments.

FIG. 9 is a flow diagram of a method 900 of using a holder assembly in an inkjet deposition apparatus according to one embodiment. In operation 902, a gas cushion table is activated by providing a flow of gas through openings in the top surface of the gas cushion table.

In operation 904, a substrate is positioned over the gas cushion table of the inkjet deposition apparatus for processing. The substrate floats on the gas cushion created by the gas cushion table without contacting the gas cushion table.

In operation 906, the substrate is aligned over the gas cushion table and over a holder assembly adjacent to the gas cushion table. The holder assembly is positioned at an edge of the gas cushion table to provide engagement with a portion of the substrate that extends beyond the edge of the gas cushion table. The edge of the substrate may be positioned directly over gripping members of the holder assembly such that the gripping members have access to acquire a secure hold on the substrate.

In operation 908, a flattening assembly is activated to press the substrate against a gripping member of the holder assembly. The flattening assembly may include a plurality of flattening members configured to apply vertical force to the surface of the substrate and ensure secure contact with a contact surface of the gripping member. The flattening assembly can include a motive source which causes a shaft to move from a first rotary position, or open position, to a second rotary position, or closed position. In the second position, a surface of the flattening members is pressed against the surface of the substrate. Some flattening assemblies include positioning elements that regulate a position of the flattening members by monitoring and controlling rotary position of the shaft. Some aspects of the method also include monitoring a positioning element during rotation of the shaft between the first rotary position and second rotary position to regulate position of the shaft. In some cases, the positioning element is a flag or post fastened to the shaft that actuates a switch in the flattening assembly to turn the motive source off upon arrival of the shaft at the first or second rotary position. In some cases, the positioning element is a flag that regulates light received by a photodetector coupled to the flattening assembly, such that the change in the light signal received by the photodetector deactivates the motive source. The motive source for the flattening assembly can be a pneumatic source or an electrical motor, such as a servo motor.

In alternate embodiments, the motive source may be a linear actuator that interacts with a linear drive assembly. The linear drive assembly generally includes one or more flattening members, a support, and a coupling to the linear actuator. The linear actuator moves one or more flattening members in a linear direction toward or away from the substrate. The motive source may be attached to the holder assembly to move along with the holder assembly, or the motive source may be attached to the gas cushion table.

In operation 910, a suction source connected to the holder assembly is activated to apply a suction force against the substrate. The suction source can be a vacuum pump or an apparatus that operates according to Bernoulli's principle. By activating the suction source while the flattener is in contact with the substrate, each portion of the substrate over an opening to a passage in a gripping member is drawn against the contact surface and held against the contact surface while the suction source is in operation. The flattening assembly ensures suction is securely acquired on the substrate.

In operation 912, the motive source is operated to move the flattener to a second position away from the substrate. In the case of a rotary drive assembly, the rotary drive assembly is moved to the second rotary position after activation of the suction source to prevent any unwanted interaction between the substrate and the flattening assembly. In the case of a linear drive assembly, the linear actuator is operated to move the flattener away from the substrate. In operation 714, the holder assembly is moved to translate the substrate over the gas cushion table for processing.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of manipulating a substrate, comprising:

placing the substrate over a gas cushion table, where an edge of the substrate is aligned with a holder assembly along one side of the gas cushion table;

bringing a bottom surface of the substrate in vertical proximity to a gripping member of the holder assembly;

applying suction to the bottom surface of the substrate through the gripping member; and applying contact force on a top surface of the substrate to engage the substrate with the gripping member.

2. The method of claim 1, wherein applying contact force on a top surface of the substrate further comprises moving a force applicator to a pressing position of the holder assembly, and further comprising removing the force applicator from the top surface of the substrate.

3. The method of claim 1, wherein applying suction through the gripping member is subsequent to aligning the edge of the substrate with the holder assembly.

4. The method of claim 1, wherein bringing the bottom surface of the substrate in vertical proximity to the gripping member further comprises moving the substrate laterally over the gas cushion table.

5. The method of claim 1, wherein bringing the bottom surface of the substrate in vertical proximity to the gripping member further comprises moving the gripping member laterally to a position below the substrate.

6. The method of claim 1, further comprising aligning the substrate over the gas cushion table.

7. The method of claim 6, further comprising holding the substrate over the gas cushion table in an aligned position prior to applying suction through the gripping member.

* * * * *